United States Patent [19]

Psaras et al.

[11] 4,235,249

[45] Nov. 25, 1980

[54] METHOD AND APPARATUS FOR PRODUCING EXPANDED TOBACCO FROM WHOLE TOBACCO STEMS

[75] Inventors: John D. Psaras; Leroy R. Sachleben, both of Louisville, Ky.

[73] Assignee: Brown & Williamson Tobacco Corp., Louisville, Ky.

[21] Appl. No.: 929,640

[22] Filed: Jul. 31, 1978

Related U.S. Application Data

[63] Continuation of Ser. No. 705,740, Jul. 15, 1976, abandoned.

[51] Int. Cl.[3] ..... A24B 3/18

[52] U.S. Cl. ..... 131/137; 131/138; 131/140 P

[58] Field of Search ..... 131/133–139, 131/140 P, 140 R

[56] References Cited

U.S. PATENT DOCUMENTS

| | | | |
|---|---|---|---|
| 2,596,183 | 5/1952 | Sowa | 131/137 |
| 3,204,641 | 9/1965 | Jones | 131/140 R |
| 3,690,328 | 9/1972 | Quarenght | 131/140 R |
| 3,742,961 | 7/1973 | Waller | 131/133 R |
| 3,786,818 | 1/1974 | Johnson | 131/140 P |

*Primary Examiner*—V. Millin

*Attorney, Agent, or Firm*—Charles G. Lamb; William J. Mason

[57] ABSTRACT

Whole tobacco stems are converted to expanded tobacco particles by opening the cellular structure of the stems and moisturizing the stems by the simultaneous application of water and steam. The stems, at a first induced moisture content of from 20 to 40% are then subjected to an equilibration step where the moisture content of the stem is uniformly distributed within the stems. The equilibrated stems are thereafter moisturized to a second induced moisture content by first an application of water and thereafter the simultaneous application of water and steam. At the second induced moisture content of from 30 to 60% the stems are cut into a plurality of particles that are thereafter expanded and dried to a final moisture content of from 13 to 25%.

31 Claims, 5 Drawing Figures

57
51
58
18
22
Water
21
Water
21
Upper Conveyor Control
Control System
23
20
32
24
5
40
5
19
Steam
46
Water
34
25
20
42
19
Steam
30
46
26
Water
55
36
20
44
19
Steam
28
46
Water
52
38
54
56
Lower Conveyor Control

METHOD AND APPARATUS FOR PRODUCING EXPANDED TOBACCO FROM WHOLE TOBACCO STEMS

This is a continuation of application Ser. No. 705,740, filed July 15, 1976 now abandoned.

BACKGROUND OF THE INVENTION

The relatively high cost of the tobacco components for smoking articles renders it desirable to fully utilize all of the tobacco leaf including the stems and veins of the tobacco leaf.

As used in the present disclosure, the term "stem" shall include both the stem as such, as well as the veins separable from the remainder of the tobacco leaf.

Prior art processes for treating tobacco stems generally consist of moisturizing the stems to a desired moisture content by applying water and steam to the stems. The stems are then rolled to break down the fibrous structure of the stem, additional moisture may then be applied to the stem, and thereafter the stem is cut into particles. The particles are bulked to equilibrate their moisture content and then further treated by expanding the particles with an additional application of steam. Drying of the expanded particles forms an expanded particulate tobacco product useful as a filler in smoking articles. Typical of such processes are U.S. Pat. Nos. 3,690,328 To Quarenghi and 3,734,104 to Buchanan et al.

The major disadvantage of such processes include the significant generation of fine particles and meal due to the rolling step where the stem is crushed to enhance moisture penetration of the stem. The production of such fine particles reduces the overall yield of usable materials, thereby reducing the cost of effectiveness of utilizing such tobacco by-products. Another disadvantage of prior art processes is the excessive consumption of power needed to generate the steam for the different moisturizing operations used in such processes. A third disadvantage of the prior art is the necessity for a time-consuming bulking step where the cut and moisturized tobacco stem particles are confined in an enclosed container to equilibrate moisture throughout the particles prior to the final application of steam and expansion of the particles into the final product.

An alternative process is disclosed in U.S. Pat. No. 3,204,641 to Jones in which tobacco stems are moistened to a moisture content of 40 to 65% followed by shredding. A lengthy bulking step, i.e., 30 minutes to several days is still required, however.

The present invention produces such expanded tobacco particles without the attendant difficulties of the prior art. Therefore, it is one object of the present invention to produce expanded particulate tobacco products useful as a filler at low energy consumption. It is an additional object of the invention to produce such a product without the significant generation of fine particles. It is a further object of the invention to produce the particulate tobacco material without the necessity for the time-consuming bulking step.

The present invention also provides a more uniform moisture content throughout the particles than such prior art processes without the necessity of the rolling step. The elimination of the rolling step and the more efficient application of steam to the product result in a significant increase in process economics.

In addition, the practice of the invention results in a significant increase in the fill power of the product. The increased fill power of the product results in a smoking article having the same apparent density as a smoking article utilizing other conventionally produced expanded tobacco particles. However, less of the product of the present invention is needed to produce that apparent density.

Further objects and advantages of the invention will be set forth in part in the description which follows and in part will be obvious from the description or may be learned by practice of the invention. The objects and advantages of the invention may be realized and attained by means of the instrumentalities and combinations particularly pointed out in the appended claims.

SUMMARY OF THE INVENTION

The present invention is a process and apparatus for the production of cut and expanded tobacco particles from whole tobacco stems.

The cellular structure of the stems is opened to the infusion of moisture without significant degradation of the structure. Moisture is thereafter induced into the cellular structure in an amount in the range of from 20 to 40 weight percent. The stems at this first induced moisture content are thereafter equilibrated to provide uniform moisture throughout the cross-section of the stems. After equilibration, the stems are further moisturized to a second induced moisture content in the range of from 30 to 60 weight percent. The stems are cut into a plurality of moisturized tobacco particles at the second induced moisture content and thereafter expanded and subsequently dried to a final moisture content of from 13 to 25 weight percent.

Preferably, the opening of the cellular structure and inducing moisture into the stems to the first induced moisture content comprises simultaneously applying water and steam to the stems.

Preferably, the first induced moisture content is in the range of from approximately 30 to 34% and is induced in a rotating inclined cylinder having means to apply steam and water to the stems.

It is also preferred that the second induced moisture content at which the whole tobacco stems are cut be approximately 42 to 44 weight percent.

It is also preferred that the equilibration step consist of confinement of the whole tobacco stems in a closed container for a period of time from 10 to 15 minutes.

BRIEF DESCRIPTION OF THE DRAWINGS

The accompanying drawings illustrate one embodiment of the invention and, together with the description, serve to explain the principles of the invention.

Of the drawings.

DETAILED DESCRIPTION OF THE INVENTION

The present invention is a method and apparatus for forming expanded particulate tobacco from whole tobacco stems by moisturizing the stems to a uniform moisture content to allow subsequent cutting, expanding and drying steps to be carried out without the normally attendant problems of production of fine particles or excessive energy consumption.

In accordance with the invention, the first step in the treatment of the whole tobacco stems is opening the cellular structure of the tobacco stems to the infusion of moisture without significant physical degradation of the cellular structure. Concurrently, moisture is induced into the cellular structure to a first induced moisture content of from 20 to 40%. The moisture contents expressed throughout the specification, unless otherwise indicated, are expressed utilizing a moisture included basis. Preferably, this first induced moisture content is achieved by the simultaneous application of steam and water to the stems with the stems reaching a temperature in the range of from 120° to 160° F. It is also preferred that the first induced moisture content of the tobacco stems be approximately 30 to 34% and the water used in the moisturization be at a temperature of 180° F. Since the stems normally have an initial moisture content of from 10 to 15%, not all of the moisture within these stems at the first induced moisture content is due to the first moisturizing step.

Figure 4:
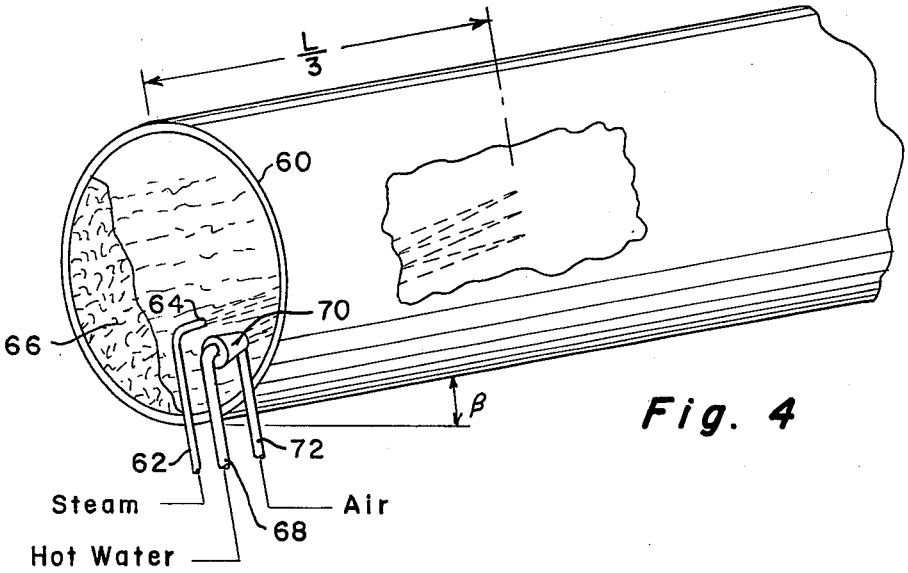
FIG. 4 is a schematic cross-section of a preferred apparatus for simultaneously applying water and steam to tobacco stems.

It is also preferred that the first moisturizing step be carried out in a specific apparatus. The preferred apparatus for carrying out the first moisturizing step is depicted in FIG. 4 comprising an elongated cylinder 60 having a steam conduit 62 and a spray nozzle 64 at an interior position. Preferably, the cylinder is inclined along its length at an angle from horizontal $\beta$, of approximately 7 degrees with the tobacco stems being introduced at the upper end of the cylinder and the stems at the first induced moisture content exiting from the lower end of the cylinder 60. The cylinder is rotated about 20 revolutions per minute with the inclination and rotation of the cylinder 60 inducing the tobacco stems within the cylinder to form a mass 66 having generally the profile indicated in FIG. 4. The majority of the tobacco stems in the mass 66 are located within a specific portion of the cross-section of the cylinder and extend along the length of the cylinder. The location and configuration of the mass depends upon the speed of rotation of the cylinder, its angle of inclination, the flow rate of the material and the physical characteristics of the material.

The cylinder 60 includes separate conduits for the introduction of the water and steam. Water conduit 68 includes a nozzle 70 receiving compressed air through air conduit 72 to form a water spray from the nozzle 70. The cylinder 60 also includes a steam conduit 62 that directs steam to the interior of the cylinder. Particular success has been experienced in utilizing saturated steam at approximately 140 psig which has a temperature at that pressure of about 360° F. Preferably, the nozzle 70 and the steam conduit 62 direct the water spray and steam to the interior of the cylinder 60 at an interior location approximately one-third of the length of the cylinder from its lower end. Since the inclination and rotation of the cylinder tends to locate the stems within a mass 66 indicated in FIG. 4, it is also preferred that the nozzle 70 and the steam conduit 62 direct the mixture of water and steam directly onto the mass 66.

In accordance with the invention, the third step of the process of the present invention is the equilibration of the first induced moisture content to the entire thickness of the stem. This is accomplished by confining the stem in a closed container for a time in excess of 10 minutes, and preferably about 15 minutes. If the equilibration step is carried out for a time less than the preferred value, the inherent variations in the stem structure and size will prevent uniform diffusion of the water into the interior portions of the stem and induce variations in the moisture content of the stems. Such variations result in non-uniform properties of the final product that create difficulties in subsequent processing and use of the product. Equilibration for a period in excess of about 15 minutes does not result in any significant beneficial effect since the moisture is already uniformly distributed. Furthermore, a lengthy equilibration step adversely affects the economics of the process.

The equilibration process utilizing a moisture impervious closed container, as for example the schematically represented container 80, is normally termed bulking in the art of tobacco technology. In the prior art, tobacco stems are rolled, moisturized and cut with the tobacco particles subjected to a bulking step generally in excess of 30 minutes. The present invention provides both a savings in elimination of the rolling step and the necessity for the lengthy equilibration or bulking step necessitated by processes of the prior art.

Subsequent to the shortened bulking step, the whole stems are moisturized to a second induced moisture content in the range of from 30 to 60% by the initial application of water to the stems followed by the simultaneous application of water and steam. This step is preferably carried out in the apparatus depicted in FIGS. 3 and 5.

In accordance with the invention, means are provided for feeding the equilibrated tobacco stems to the means for further moisturization. As here embodied and depicted in FIG. 3, the apparatus includes a partially enclosed conveyor 57 having a conveyor belt 58 delivering the stems to conduit 18. In this manner the bulked stems are transported from the equilibrating container 80 to the means for further moisturization.

A cylindrical vertical conduit 18 includes an upper portion 22 and a lower portion 25. The lower portion 25 has a plurality of orifices 20 therein and conducts the premoisturized and equilibrated tobacco stems vertically downward. At the upper portion 22 of the conduit 18, there is provided means for injecting water into the conduit shown here simply as spray inlets 21. Water is introduced to the upper portion 22 and passes into the conduit 18 moisturizing the stems in that portion of the device. Preferably, the water introduced by inlets 21 at a temperature of approximately 180° F. and increases the moisture content of the stems approximately 10 percent.

In the upper portion 22 of the conduit 18 the stems preferably free fall while being subjected to water spray from inlets 21. By contrast, it is preferred to accumulate the stems in the lower portion 25 as a column of stems in contact with one another. The stems move through the conduit controlled by the rate of input of stems to the upper extremity of the conduit 18 and the rate of output of the stems from the lower extremity of the conduit, preferably in the time range of two (2) to six (6) minutes. As depicted schematically in FIG. 3, there is provided a detector 23, preferably a photocell, that detects the upper extremity of the column of stems and maintains the upper level of the column by altering the input or output rate of the stems from the conduit. For purposes of this disclosure, a column of stems means a plurality of stems that have accumulated within the conduit to the point where adjacent stems are lying on top of each other. This is in contrast to the preferred condition of the stems in the upper portion 22 of the conduit 18 where they free fall while receiving additional moisture.

The lower portion 25 of the conduit 10 is surrounded by a plurality of chambers 24, 26 and 28. In the embodiment depicted, the chambers are formed by a cylindrical member 30 surrounding the conduit 18 with a plurality of radially disposed separating members 32, 34, 36 and 38 forming the three chambers. A mixture of water and steam is introduced to the three chambers with the temperature and flow rates of the water and steam being capable of independent adjustment. The mixture introduced to the chambers passes through the orifices 20 and into the stems within the conduit.

The steam component of the mixture supplies very little of the moisture retained by the tobacco stems. Apparently, the presence of the steam opens the structure of the tobacco and enhances diffusion of the water into the interior portions of the stem. While this parameter is not known to be critical, a steam input rate of 500 pounds per about 1000 pounds of dry stems has been found to be sufficient to promote additional diffusion of water into the stems. Dry stems contain approximately 13% moisture by weight on an included basis. The parameter is based on a weight of dry stems even though the stems input to the second moisturizing step have a significant moisture content. The elimination of the water from the above parameter merely eliminates the effect of the weight of the added moisture in the stems on the steam input rate.

Since the water is primarily responsible for the additional moisturization, the rate of water input is directly proportional to the input moisture content, the flow rate of stems, and the desired final moisture content.

Particular success has been experienced in the embodiment depicted where the steam and water mixture is applied to the outer surface of the conduit 18 at three spacially separate portions along the length of the conduit. In the embodiment depicted, the three separate portions are those portions of the conduit within the three chambers 24, 26 and 28. The uppermost portion of the conduit receives a mixture at a flow rate sufficient to increase the moisture content of the stems approximately three percent. The middle portion of the conduit receives a mixture at a flow rate sufficient to cause the moisture content of the stems approximately one percent, while the lowermost portion receives a mixture at a flow rate sufficient to increase the moisture content of the stems less than one percent and achieve the desired final induced moisture content.

The steps of the process to this point and the apparatus for inducing the first and second moisture contents and equilibration are disclosed in further detail in U.S. patent application Ser. No. 705,741, now U.S. Pat. No. 4,102,349, entitled "A Method and Apparatus for Moisturizing Whole Tobacco Stems" by the same inventors as the present invention and assigned to a common assignee, the specification of which is incorporated herein by reference thereto.

As here embodied, the vertical cylindrical conduit 18 defines a plurality of orifices 20 that render the conduit 18 permeable to the passage of the mixture of water and steam. The mixture is applied to the outer surface of the conduit and passes through orifices 20 to permeate the stems within the conduit. Preferably, the orifices are circular and when circular, comprise approximately 35 percent of the surface area of the lower portion of the conduit 18.

The configuration of the orifices 20 in the walls of the conduit 18 are not known to be critical. This embodiment of the invention is operable when the orifices are of sufficient size to allow access of the mixture of water and steam to the column of stems while confining the stems to the interior of the conduit 18.

Figure 3:
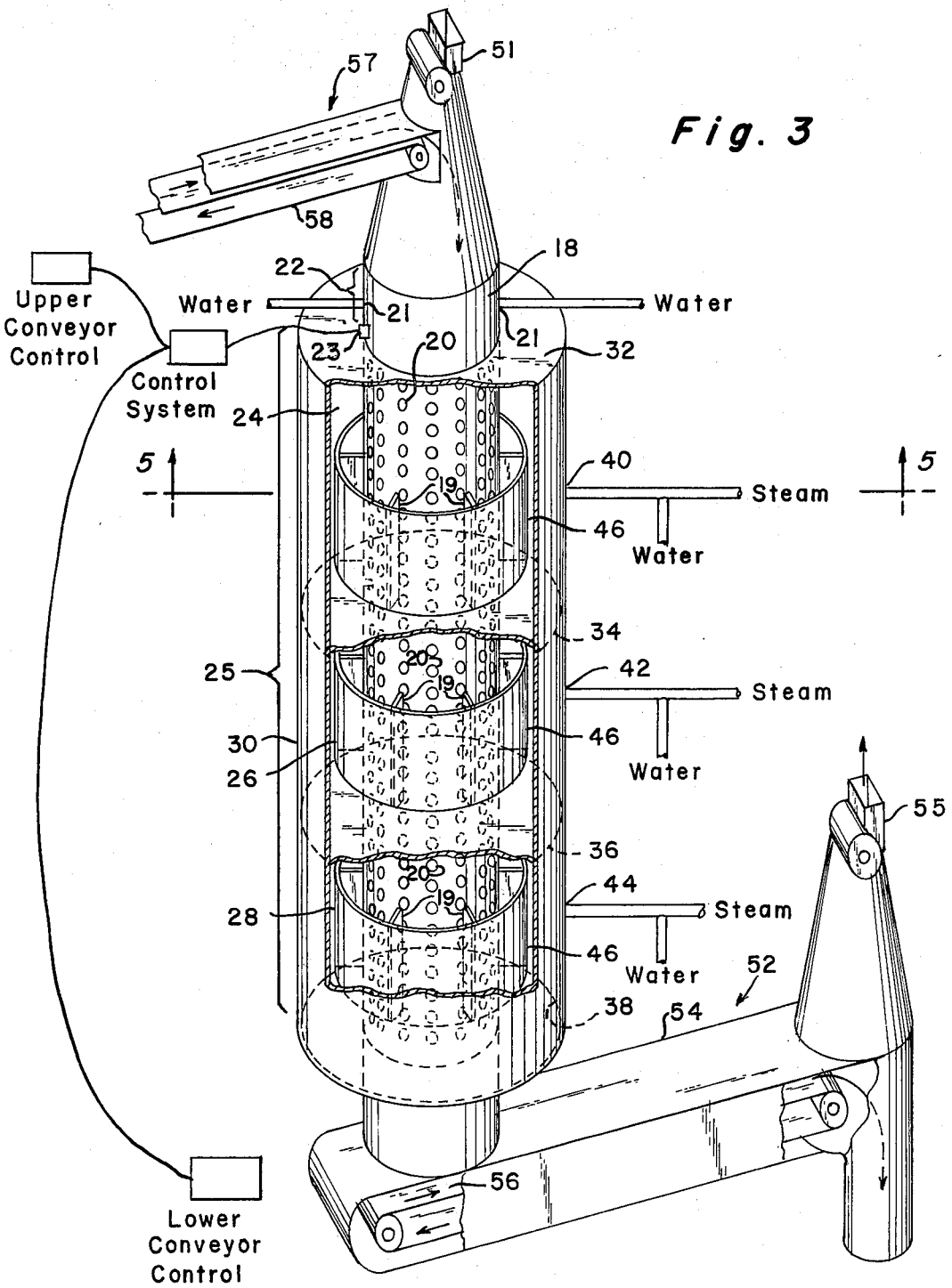
FIG. 3 is a schematic representation of a conditioning member according to the invention wherein water and subsequently the mixture of water and steam are applied to the equilibrated tobacco stems.

Preferably, the cylindrical conduit 18 is surrounded along its length by a plurality of chambers, depicted in FIG. 3 as upper chamber 24, middle chamber 26 and lower chamber 28. The chambers are each in flow communication with the stems in the conduit 18 through orifices 20. The chambers 24, 26 and 28 are preferably defined by a concentric member 30 surrounding the conduit 18 and a plurality of radially disposed separating members 34, 36 and 38 connecting the conduit 18 and the concentric member 30.

Means for introducing the mixture of water and steam to the chambers and thereby supplying steam and water to the outside surface of the conduit 18 is depicted schematically as mixture inlets 40, 42 and 44. Preferably, each of the inlets receive a mixture from independently adjustable sources of water and steam allowing different mixtures to be introduced to different chambers. As will be more fully disclosed when the operation of the preferred embodiment is described, the sources of steam and water are adjusted to apply progressively less moisture to the stems as the stems pass through the conduit 18.

While the preferred embodiment utilizes a common source of steam at similar pressure (15 psig) at each chamber, the steam sources could be independent. It is the function of the steam applied to the stems in the lower portion of the conduit 18 to heat the stems as they pass through the conduit to further promote the additional infusion and diffusion of moisture.

The present preferred embodiment also utilizes water at a temperature in the range of from 40° to 70° F., but varies the flow rate of the water to different portions of the conduit 18 to progressively decrease the amount of water applied to the stems as the stems progress through the conduit.

In accordance with the invention, there is provided means interposed between the means for supplying the steam and the outer surface of the conduit for preventing localized application of steam to the outer surface. Localized application of steam to the conduit and the stems within it results in non-uniform heating of the stems which, in turn, results in non-uniform moisturization.

Figure 5:
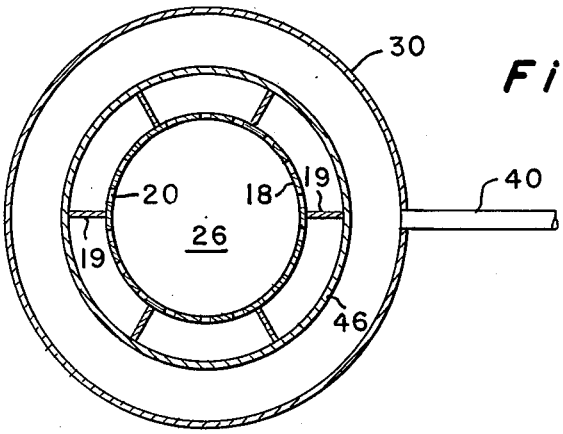
FIG. 5 is a cross-sectional view of the conditioning member of FIG. 3 at line 5—5.

As here embodied and depicted in FIGS. 3 and 5, baffles 46 are interposed between the mixture inlets 40, 42 and 44 and the outer surface of the conduit 18. While the mixture inlets in the embodiment depicted simultaneously introduce both water and steam, the baffles need only be interposed between the steam inlet and the conduit 18. Local non-uniform application of water quickly diffuses to a uniform moisture content due to the porous nature of the column of stems and the stems themselves. By contrast, the response of the stems to moisturization is temperature dependent and local heating of the stems by localized application of steam to the conduit will cause non-uniform moisturization of the stems.

The baffles of the preferred embodiment have a height less than the chamber with attaching members 19 affixing the baffles 46 to the conduit 18 in a manner to allow the flow of steam around the baffles. Atomized water passes through the orifices 20 into the conduit 18. Excess water is drained, by means not shown, from each of the separating members 34, 36 and 38.

As here embodied and depicted in FIG. 3, the receiving or exit conveyor 52 conveys the stems from the lower extremity of the conduit 18 on a conveyor belt 56. The conveyor belt 56 is within an enclosure 54 that retains the moisture within the stems. Additional equilibration (bulking) of the moisturized stems may take place as the stems are transported within the enclosure 54.

Preferably, there are provided means for extracting steam from the conduit 18 as the stems pass therethrough. As here embodied, the enclosed lower conveyor 52 includes a blower 55 in flow communication with the enclosure 54. It is also preferred that apparatus include steam-extracting means on the input portion of the conduit 18 and as here embodied, blower 51 is disposed to extract steam therefrom. The induced flow of steam through the column of stems within the conduit 18 promotes uniform heating within the column of stems.

Operation of this preferred embodiment indicates, and it is preferred, that the stems become progressively hotter as they progress toward the outlet of conduit 18. The induced flow of steam through the stem column is not intended to eliminate the temperature gradient along the length of the conduit but to eliminate local non-uniform heating within the stem column.

Since the stems already have a uniform moisture content due to the equilibration step, the sequential addition of moisture in the conduit 18 does not result in non-uniform moisture distribution in the stems as they exit the conduit at the moisture content appropriate for the cutting operation.

The stems so treated have a moisture content of from 30 to 60% and preferably, the stems have a moisture content of approximately 42 to 44 weight percent. With the stems at or near the preferred moisture content, with uniform distribution of the moisture therein, the cutting operation results in a uniform particulate product without attendant production of particulate fines or meal. In addition, the final product exhibits increased fill power when produced from stems at the preferred moisture content with the fill power decreasing as the moisture content is varied above or below the preferred range.

The stems at the second induced moisture content are subsequently subjected to a cutting operation to form unexpanded particulate tobacco stem. The cutting means is shown schematically as the cutter 50 in FIG. 1. Using a Molins Rotary Cutting Machine, cutter settings of 90, 140, 160, 180 and 200 cpi (cuts per inch) were investigated to determine the optimum particle size in terms of the characteristics of the final product and the efficiency of the cutting operation. At a setting of 160 cpi, the product exhibited significantly increased fill power and generation of undesirable material during the cutting operation was minimal. It should be understood that the setting between cutting machines are not exactly identical and a different cutting machine set at 160 cpi may not produce the optimum product.

Subsequent to the cutting operations where the whole stems are converted into a particulate form, the particulate tobacco product is expanded by the direct application of steam. Preferably, the expansion step is conducted in an apparatus similar to that depicted in FIG. 2 comprising an elongated cylinder 10 having a conduit 12 passing through the axis of rotation of the cylinder. Preferably, the cylinder is inclined along its length at an angle $\alpha$ from horizontal of approximately 7 degrees with the tobacco stems being introduced at the upper end of the cylinder and the stems exiting from the lower end of the cylinder 10. The cylinder is rotated about 20 revolutions per minute with the inclination and rotation of the cylinder 10 inducing the tobacco stems within the cylinder to form a mass having the profile indicated as 16 in FIG. 2 as they pass through the cylinder 10.

In the preferred embodiment, steam is applied only in the middle one-third of the cylinder. The axial steam conduit 12 is located along the central axis of the cylinder 10 with the openings directing the steam onto the profile of stems. As indicated by the spray pattern 14, the steam from the axial conduit 12 are directed solely to that portion of the cylinder containing the mass of tobacco. As a result of such a configuration, significant savings in power are achieved through the operation of the steaming device depicted in FIG. 2. Savings in steam consumption of up to 68% have been experienced with the operation of the steaming device depicted in FIG. 2. Savings in steam consumption of up to 68% have been experienced with the operation of the steaming apparatus depicted when compared with a similar device with the steam distributed radially from the central conduit 360° around the conduit. The cut tobacco stem particles are introduced to one end of an inclined rotating cylinder having an axial steam conduit disposed within. The particles are transported the length of the cylinder due to its inclination and rotation while steam is applied solely to the location of the majority of the tobacco particles within the cylinder.

Using such an apparatus to expand the particles results in a significant savings in energy associated with the production of steam as well as increasing the fill capacity of the particle expanded therein. A comparison of this embodiment was conducted where in one instance saturated steam at 140 psig was uniformly distributed 360° within the cylinder in comparison to the embodiment of the present invention where saturated steam at the same pressure is locally directed solely to the tobacco particles. The parameters of operation of the two conditions are illustrated in Table I, as well as the resulting steam consumption rates and relative fill power of the products expanded.

TABLE I

COMPARISON OF STEAM CONSUMPTION AND FILL CAPACITY

| | Control | Improvement |
|---|---|---|
| Cylinder Diameter (in.) | 20 | 20 |
| Length (ft.) | 11¾ | 11¾ |
| Rotation (RPM) | 20.6 | 20.6 |
| Particle Residence Time (sec.) | 55 | 55 |
| Particle Input Rate (lbs./hr.) | 700 | 1500 |
| Particle Input Moisture (%) | 42 | 42 |
| Saturated Steam Application Rate (lbs. Steam/lbs. Bone Dry Particles at 140 psig) | 3.67 | 1.15 |
| Relative Fill Capacity (%) | 1 (base) | 1.16 |

TABLE I-continued

| COMPARISON OF STEAM CONSUMPTION AND FILL CAPACITY | Control | Improvement |
|---|---|---|
| (in relation to control) | | |

Figure 2:
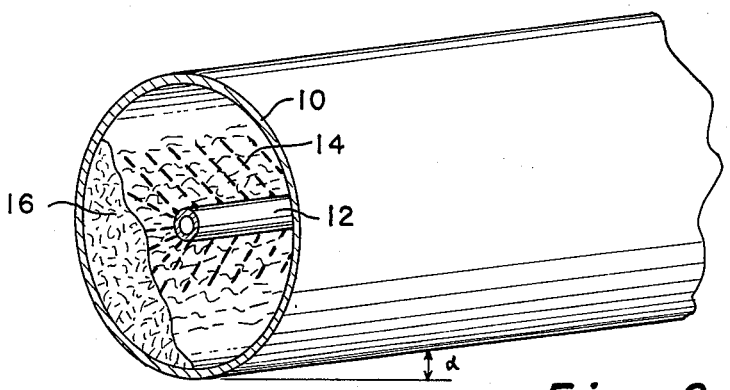
FIG. 2 is a schematic cross-section of a preferred apparatus illustrating the pattern of application of steam to the tobacco therein.

As the data illustrates, utilization of the cylinder depicted in cross-section in FIG. 2, for the expansion process, results in a significant savings in the amount of steam necessary to expand the particles. With uniform distribution of steam within the cylinder, 3.67 pounds of steam are needed for each pound of bone dry particles to be expanded while the cylinder utilizing the localized steam distribution required only 1.15 pounds of steam per pound of bond dry particles. When it is realized that such operations are applicable on a scale of millions of pounds of such particles, the significance of the energy savings associated with the reduction in the amount of necessary steam is apparent.

Surprisingly, the tobacco steam particles expanded in such an apparatus also illustrate an increase fill capacity. The fill capacity of the two particles is illustrated in relative terms with the particles from the improved process exhibiting a 16% increase in fill capacity over that of the control process. The increased fill capacity of the particles produced by the subject process results in significant economic benefits due to the larger effective yield of expanded tobacco stems.

The final step in the process is the drying of the expanded tobacco particles to a moisture content of from 13 to 25%. The apparatus used for the drying was a three-chamber pneumatic uplift dryer. This drying equipment is not a departure from ordinary means for drying tobacco particles and one skilled in the art would not need any further teaching in order to select means for drying the particles to the desired moisture content. Similarly, the particles are thereafter subjected to a classification step in which the particles are separated according to size. Again, one skilled in the art would need no specific teaching in order to accomplish such a step.

The advantages of the present invention are effectively illustrated by the following comparisons of the present invention to a specific prior art process and specific examples of its operation.

Table II compares the present invention to an embodiment of the prior art, as previously described in the Description of the Prior Art, in terms of process steps and illustrates both a savings in time by a reduction of the length of the bulking step and a reduction in the steam consumption necessary for particle expansion.

TABLE II

| PROCESS COMPARISON | Present Invention | Prior Art Process |
|---|---|---|
| Moisturize To | 30% | |
| Bulk | 15 minutes | |
| Moisturize To | 44% | 36% |
| Flatten to a Thickness of | — | 0.048" |
| Cut to Setting of | 160 cpi | 160 cpi |
| Exit Moisture of | 42% | 36% |
| Moisturize To | — | 42% |
| Bulk | — | 30 minutes |
| Steam to a Moisture of | 47% | 47% |
| At a Rate of (lbs. of Steam/lb. Bone Dry Stem) | 1.15 | 3.67 |
| Dry To a Moisture of | 21% | 21% |

The product resultant from the operation of the processes compared in Table II are compared in Table III. The relative fill power increase of 20% over the prior art process effectively illustrates one of the major advantages of the present invention. The numerical values for fill power are only relative with the value of the prior art product arbitrarily set at 1.0.

TABLE III

| PRODUCT COMPARISON | | Present Invention | Prior Art Process |
|---|---|---|---|
| Size Distribution | | | |
| % Retained on | ½" Screen | 0.09 | 0.00 |
| | ¼" Screen | 4.26 | 2.09 |
| | ⅛" Screen | 54.47 | 37.99 |
| | 1/16" Screen | 37.34 | 46.64 |
| | Pan | 4.03 | 13.27 |
| Useful final product from Dryer (%) | | 81.9 | 70.5 |
| Relative Fill Power Increase | | 1.20 | 1.0 (control) |

Figure 1:
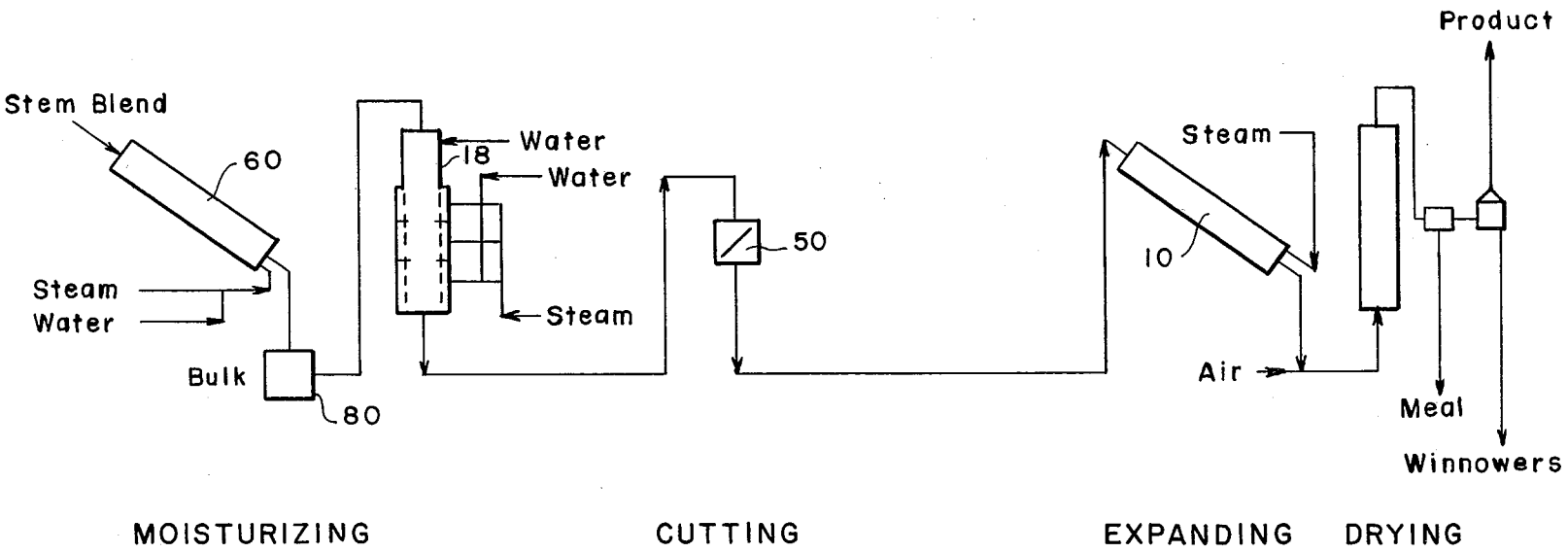
FIG. 1 is a schematic representation of the process of the present invention.

The useful final product from the dryer is that portion of the material that can be directly used as a tobacco filler and is shown in FIG. 1 as "PRODUCT".

EXAMPLES

The present invention was utilized in the following specific example where the process was carried out under the following process conditions.

EXAMPLE 1

The stems were moisturized to the first induced moisture content above 20 weight percent by continuous passage of the stems through an inclined rotating cylinder. The stem residence time within the cylinder was less than one minute and both water and steam were applied to the stems to achieve the moisture content in excess of 20% and a stem exit temperature in excess of 120° F. The apparatus used for the initial moisturizing treatment is depicted in FIG. 4.

The stems were thereafter equilibrated by confining them within a closed container for 15 minutes. Finally, the stems were passed through a vertical conduit in which hot water (170°-180° F.) was initially applied to the stems and subsequently a mixture of water and steam was applied to the stems. The moisture contents of the stems are disclosed in the Examples and in all cases, the temperature of the stems was increased to greater than 195° F.

The moisture contents of the stems are disclosed in the Examples as: an Initial Moisture Content, prior to entering the element 60 in FIG. 4; a First Induced Moisture Content exiting element 60 prior to the bulking (equilibration); and, a Second Induced Moisture Content of the stems as they exit the conduit 18 of FIG. 3. The present invention is compared to the Final Moisture Content of a Control process where the stems are moisturized by conventional techniques (previously described on page 2 of the specification) to illustrate the benefit of the present invention.

The variation of the moisture level of the stems at various process steps is compared with the above-identified prior art process. This example illustrates the more uniform moisture content of tobacco stems and particles treated by the present invention.

Aged flue-cared stems were moistured in the preferred process and the moisture variations compared to a control process using the same stems.

| | Initial Moisture Content of Stems | At First Induced Moisture Content (without bulking) | At Second Induced Moisture Content | Final Moisture Content for Control |
|---|---|---|---|---|
| Mean | 9.20 | 32.84 | 41.6 | 40.8 |
| Standard Deviation | 0.745 | 4.854 | 1.404 | 5.345 |
| 95% C.L. | ±0.6 | ±3.5 | ±1.2 | ±4.1 |

The 95% C.L. (95% Confidence Limits) establishes that the mean moisture of the stem population lies within those limits at a 95% probability level. It is a direct indication of the variation of the moisturized stems and is derived from the deviations from the mean.

As the example illustrates, the stems at the second induced moisture content using the present invention are more uniformly moisturized than those of the prior art process. This significantly improves the overall process of forming expanded tobacco particles by reducing the amount of meal and fines produced in cutting the moisturized stems.

EXAMPLE 2

Whole tobacco stems were processed using the preferred embodiment depicted in the figures noting the rate of moisture addition at the various process operations where water is introduced to the stems. In units of gallons per 1000 pounds of whole stems, the rates of moisture additions were as follows:

| | |
|---|---|
| Initial moisturization with the cylinder 60 | 29.1 |
| Moisturization in the upper portion 22 of the conduit 18 | 14.1 |
| Moisturization in the top chamber 24 of the conduit 18 | 13.9 |
| Moisturization in the middle chamber 26 of the conduit 18 | 9.5 |
| Moisturization in the lower chamber 28 of the conduit 18 | <1 |

The stems in this example were moisturized to approximately 44%

The process of the present invention has been disclosed with several process steps applying water, steam or mixtures thereof to obtain specific effects. In some operations, the effect is a physical change of structure and in others the infusion of moisture. It has been found that the application of steam results primarily in physical changes to the tobacco structure with very little of the steam affecting the moisture content of the product. With this understanding of the process, one skilled in the art can achieve the specified moisture contents by material balance calculations and appropriate process control.

Operation of the invention within the preferred process parameters results in significant advantages in product quality and process economics and while none of the preferred parameters are known to be critical to process operation, they are not merely the simple optimization of process parameters. Significant improvements in the process and product result from operation within the preferred embodiments although the process is operable and superior to prior art processes when operated outside the preferred ranges. Operation of the process outside the broad teaching of the present invention may result in the expansion of the stems being merely temporary with a later reduction in the fill power of the product. In addition, it has been discovered that the present process results in the removal of some constitutents of the stems that, when present, detrimentally affect the market acceptability of articles incorporating the product of the process. Therefore, the present invention does not result in improvements in process and product economics, but causes a significant improvement in the acceptability of the product of the present invention.

THE APPARATUS

The apparatus embodiment of the present invention forms whole tobacco stems into a plurality of expanded tobacco particles suitable for inclusion in smoking articles.

In accordance with the invention, the apparatus includes means for opening the cellular structure of the stems to the infusion of moisture by the simultaneous application of water and steam.

As here embodied and depicted in FIG. 4, there is provided an inclined, rotating, cylindrical member 60 that receives the stems at the upper end of the cylinder. The specific configuration of the embodiment of FIG. 4 has been previously disclosed.

A similar embodiment can be used for expanding the cut tobacco stems. As depicted in FIG. 2, and previously disclosed, the spray pattern 14 is solely of steam which is directed toward the tobacco particles within the cylinder. In such an embodiment, the location of tobacco particles would be approximately depicted by the pile of stems 16. Directing the steam solely to the location of the stems or particles significantly improves the efficiency of the processes without detrimental effects on the products so treated.

In accordance with the invention, the apparatus includes means for equilibrating the moisture content within the stems. This is commonly termed a bulking step in the tobacco art and comprises placing the stems within a moisture-impervious, closed container for a period of time sufficient to allow diffusion of the water within the stems throughout the entire cross-section of the stems.

In accordance with the invention, means are provided for further moisturizing the equilibrated stems by sequentially applying water and thereafter, water and steam to the stems. As here embodied and depicted in FIG. 3, the means for such further moisturization of the equilibrated stems comprise a vertically disposed conduit 18 including a plurality of orifices 20 passing through its lower portion. The chambers 24, 26 and 28 are in flow communication with the interior of the conduit through the orifices 20. It is the function of the chambers to distribute and apply the mixture of water and steam supplied to the chambers through the orifices 20 to the stems as they pass through the interior of the conduit.

It is further preferred that the apparatus include means at the upper portion of the conduit 18 for applying water in the form of a spray to the stems within the upper portion 22 of the conduit 18. In such a manner, the equilibrated stems passing through the conduit achieve the second induced moisture content of between 30 and 60 weight percent with the uniformity of the moisture content superior to prior art processes. This uniformity significantly reduces the generation of meal and fine particles during the cutting operation where the stems are sub-divided to form the moisturized particles.

In accordance with the invention, the apparatus further includes means for cutting the stems into a plurality of particles. The present invention produces moisturized stems at conventional moisture contents and therefore utilizes conventional cutting means. While a Molins Rotary Cutting Machine was utilized with the present invention, those having skill in this art may select other means of comminuting the stems.

In accordance with the present invention, means are provided for expanding the particles. As previously disclosed and illustrated by the comparison of Table I, the embodiment of FIG. 2 is preferred for the expanding means. The use of such an embodiment for the expansion of the moisturized tobacco particles provides a product having superior fill power and reduces the energy required for the expansion.

In accordance with the invention, means are provided for drying the expanded particles to a moisture content suitable for inclusion of the product within a smoking article. The present invention contemplates standard drying means and one skilled in the art needs no specific teaching of such means to dry the expanded particles to the desired moisture content of from 13 to 25 weight percent.

Having disclosed the process and novel apparatus used in the process in terms of a preferred embodiment, the scope of the invention is not to be limited thereto since one skilled in the art can utilize the invention in embodiments other than those illustrated. The scope of the invention is to be measured solely by the appended claims.

What is claimed is:

1. A process for the production of cut and expanded tobacco particles from whole tobacco stems which comprises:

(a) opening the cellular structure of said stems to the infusion of moisture without significant physical degradation of said cellular structure;

(b) inducing moisture into said cellular structure in an amount in the range of from 20 to 40 weight percent, said range being a first induced moisture content and simultaneously therewith, heating said stems to a temperature of at least 120° F.;

(c) equilibrating the moisture content in said opened and induced stems;

(d) moisturizing said equilibrated stems to a second induced moisture content in the range of from 30 to 60 weight percent at a temperature of at least 160° F.;

(e) cutting said stems after step (d) above, at said second induced moisture content, into a plurality of moisturized tobacco stem particles;

(f) expanding said cut particles; and (g) drying said expanded particles to a final moisture content in the range of from 13 to 25 weight percent.

2. The process of claim 1 wherein the step of opening said cellular structure and the step of inducing moisture into said stems to said first induced moisture content comprises simultaneously applying water and steam to said stems.

3. The process of claim 2 wherein the step of inducing moisture into said stems to said first induced moisture content includes heating said stems to a temperature in the range of from 120° to 160° F.

4. The process of claim 2 wherein the step of simultaneously applying water and steam includes applying said water at a temperature of approximately 180° F. to said stems.

5. The process of claim 1 wherein the steps of opening said stems to the infusion of moisture and moisturizing said stems to said first induced moisture content comprise passing said stems through an inclined rotating cylinder while simultaneously directing steam and water solely toward said stems.

6. The process of claim 5 wherein the step of inducing moisture into said stems to said first induced moisture content includes heating said stems to a temperature in the range of from 120° to 160° F.

7. The process of claim 5 wherein the step of simultaneously applying water and steam includes applying said water at a temperature of approximately 180° F.

8. The process of claim 1 wherein the step of inducing moisture into said stems results in said stems having a first induced moisture content in the range of from 30 to 32 weight percent.

9. The process of claim 1 wherein said equilibrating step comprises confining said stems at said first induced moisture content within a moisture impervious closed container for a time in excess of 10 minutes.

10. The process of claim 9 wherein said equilibrating step comprises confining said stems at said first induced moisture content within a moisture impervious closed container for a time of approximately 15 minutes.

11. The process of claim 1 wherein the step of moisturizing said stems to said second induced moisture content comprises passing the equilibrated stems through a vertically disposed conduit having upper and lower portions, said conduit having a plurality of orifices in the lower portion thereof, initially applying water to said stems in the upper portion of said conduit and subsequently applying water and steam simultaneously through said orifices to said stems passing through the lower portion of said conduit.

12. The process of claim 11 wherein the step of moisturizing said stems to said second induced moisture content results in said stems having a moisture content of approximately 44 weight percent.

13. The process of claim 11 wherein the step of simultaneously applying water and steam to said stems to achieve said second induced moisture content utilizes water and steam at 212° F.

14. The process of claim 11 wherein the step of initially applying water to said stems comprises applying water to said stems as they free fall within the upper portion of said conduit.

15. The process of claim 11 wherein the step of simultaneously applying water and steam includes moving said stems through said conduit as a column.

16. The method of claim 11 wherein the moisturizing of the equilibrated stems to the second induced moisture content is accomplished in stages of ever decreasing amounts to trim the moisture content to the desired level while effecting a uniform diffusion of moisture through the stems and from stem to stem.

17. The method of claim 11 wherein the step of initially introducing water to said stems increases the moisture content of said equilibrated stems approximately ten percent.

18. The method of claim 17 wherein the step of moisturizing said stems to said second induced moisture content includes applying said mixture to said conduit at three spacially separate portions along the length of said conduit, the uppermost portion of said conduit receiving said mixture at a flow rate sufficient to increase the moisture content of said stems approximately three percent, the middle portion of said conduit receiving said mixture at a flow rate sufficient to increase the moisture content of said stems approximately one percent and the lowermost portion of said conduit receiving said mixture at a flow rate sufficient to increase the moisture content of the stems less than one percent achieving the desired second induced moisture content.

19. The method of claim 11 including the step of increasing the temperature of said stems as said stems progress through said conduit.

20. The process of claim 1 wherein the step of expanding said particles comprises passing said particles through an inclined rotating cylinder and applying steam solely to said particles.

21. The process of claim 20 wherein the step of expanding said particles results in said expanded particles having a moisture content of approximately 47 weight percent prior to said drying step.

22. An apparatus for forming whole tobacco stems into a plurality of expanded tobacco particles suitable for inclusion in smoking articles, said apparatus comprising:

(a) means for opening the cellular structure of said stems to the infusion of moisture by the simultaneous application of water and steam;
(b) means of equilibrating the moisture content within said stems;
(c) means for further moisturizing said equilibrated stems by sequentially applying water and thereafter water and steam to said stems;
(d) means for cutting said stems into a plurality of particles;
(e) means for expanding said particles; and
(f) means for drying said expanded particles.

23. The apparatus of claim 22 wherein the means for opening the cellular structure of said stems comprises an inclined rotating cylindrical member for receiving said stems at the upper end thereof, said stems being induced to occupy a portion of the cross-section of said cylindrical member by the rotation and inclination of said member, means for directing steam to a limited portion of said stems, and means for directing water to a limited portion of said stems within said cylindrical member.

24. The apparatus of claim 22 wherein said expanding means comprises: an inclined rotating cylindrical member for receiving said particles at the upper end thereof, said particles being induced to occupy a portion of the cross-section along the length of said cylindrical member by the rotation and inclination of said member, said member including a central axial conduit disposed within said member at its approximate axis of rotation, said central conduit having a plurality of orifices therein, said orifices being disposed to direct steam passing therethrough solely to the location in said member where said tobacco particles are located.

25. The apparatus of claim 22 wherein said equilibrating means is a moisture impervious closed container.

26. The apparatus of claim 22 wherein the means for further moisturizing said equilibrated stems comprise:

(a) a vertically disposed conduit including a plurality of orifices passing through its lower portion;
(b) means at the upper portion of said conduit for applying water in the form of a spray to said stems within said upper portion of said conduit; and
(c) a plurality of chambers surrounding the lower portion of said conduit, said chambers being in flow communication with the interior of said conduit through said orifices, said chambers being disposed to distribute and apply water and steam supplied to said chambers to said stems pasing through the interior of said conduit.

27. The apparatus of claim 26 wherein the means for supplying the mixture of water and steam include a plurality of chambers disposed along the length of the lower portion of said conduit, said chambers surrounding said conduit and in flow communication with said stems through said permeable walls, and means for introducing said steam and water to said chambers.

28. The improvement of claim 27 wherein said apparatus includes three chambers.

29. The improvement of claim 26 wherein said conduit is cylindrical with said chambers being defined by a substantially concentric member surrounding said conduit and a plurality of radially dispoed separating members connecting said concentric member and said conduit.

30. The improvement of claim 29 including means for preventing localized application of steam to an outer surface of said conduit which comprise baffles interposed between the means for supplying said steam and said outer surface, said baffles allowing flow of said steam around said baffles and through said permeable walls.

31. The improvement of claim 30 wherein said conduit is cylindrical with said baffles being substantially concentric with said conduit.

* * * * *

UNITED STATES PATENT AND TRADEMARK OFFICE

CERTIFICATE OF CORRECTION

PATENT NO. : 4,235,249

DATED : 11/25/80

INVENTOR(S) : John D. Psaras, et. al.

It is certified that error appears in the above—identified patent and that said Letters Patent is hereby corrected as shown below:

At column 9, line 21, please correct the word "steam" to read "stem".

Signed and Sealed this

*Fifth* Day of *May 1981*

[SEAL]

*Attest:*

RENE D. TEGTMEYER

*Attesting Officer* *Acting Commissioner of Patents and Trademarks*